US008387268B2

(12) United States Patent
Ahn et al.

(10) Patent No.: US 8,387,268 B2
(45) Date of Patent: Mar. 5, 2013

(54) DRYER AND FOREIGN MATERIAL REMOVING APPARATUS THEREOF

(75) Inventors: Seung Phyo Ahn, Changwon (KR); Jeong Yun Kim, Changwon (KR); Sang Ik Lee, Changwon (KR)

(73) Assignee: LG Electronics Inc., Seoul (KR)

( * ) Notice: Subject to any disclaimer, the term of this patent is extended or adjusted under 35 U.S.C. 154(b) by 376 days.

(21) Appl. No.: 12/640,219

(22) Filed: Dec. 17, 2009

(65) Prior Publication Data

US 2010/0154241 A1 Jun. 24, 2010

(30) Foreign Application Priority Data

Dec. 22, 2008 (KR) ..... 10-2008-0130800

(51) Int. Cl.
*F26B 21/06* (2006.01)
*F26B 5/06* (2006.01)
*F26B 3/00* (2006.01)

(52) U.S. Cl. ..... 34/82; 34/300; 34/480

(58) Field of Classification Search ..... 34/82, 300, 34/480

See application file for complete search history.

(56) References Cited

U.S. PATENT DOCUMENTS 7,020,986 B1 * 4/2006 Nakai et al. ..... 34/596
2008/0104862 A1 * 5/2008 Dittmar et al. ..... 34/601

FOREIGN PATENT DOCUMENTS

| | | | |
|---|---|---|---|
| CN | 2841738 | Y | 11/2006 |
| DE | 7117465 | U | 10/1972 |
| DE | 8224528 | | 2/1983 |
| DE | 32 34 436 | A1 | 3/1984 |
| DE | 8437357 | | 3/1985 |
| DE | 19705616 | | 8/1998 |
| KR | 96-15139 | U | 5/1996 |
| KR | 10-2007-0073144 | A | 7/2007 |
| KR | 10-2007-0075596 | A | 7/2007 |
| KR | 1020070075596 | A * | 7/2007 |

OTHER PUBLICATIONS

Chinese Office Action dated May 11, 2011 issued in Application No. 200910262224.9.

* cited by examiner

*Primary Examiner* — Kenneth Rinehart
*Assistant Examiner* — John McCormack
(74) *Attorney, Agent, or Firm* — KED & Associates LLP

(57) ABSTRACT

A dryer and a foreign material removing apparatus thereof are provided. The foreign material removing apparatus includes a case; a first filter housed in the case; and a second filter disposed downstream from the first filter based on a direction of air flow in the case, the first filter and the second filter performing a relative motion with respect to each other.

15 Claims, 9 Drawing Sheets

DRYER AND FOREIGN MATERIAL REMOVING APPARATUS THEREOF

CROSS-REFERENCE TO RELATED APPLICATIONS

The present application claims priority under 35 U.S.C. 119 and 35 U.S.C. 365 to Korean Patent Application No. 10-2008-0130800 (filed on Dec. 22, 2008), which is hereby incorporated by reference in its entirety.

BACKGROUND

The embodiment relates to a dryer and a foreign material removing apparatus thereof.

In general, a dryer is an apparatus that dries a dry target by blowing hot wind generated by a heater into a rotary drum to absorb moisture of a drying target (i.e., clothes which has been washed).

The dryer is largely classified into an exhaust type dryer and a condensation type driver in accordance with a processing scheme of wet air containing moisture generated by drying the drying target.

More specifically, the exhaust-type dryer discharges the wet air discharged from the drum to the outside of the dryer. Meanwhile, the condensation-type dryer removes the moisture by condensing the wet air discharged from the drum in a heat-exchanger and thereafter, heats a dry air without moisture again and sends it to the drum.

Meanwhile, since the drum rotates in a drying process, the drying target housed in the drum is wound in the drum as the drum rotates. In this process, foreign materials contained in the drying target are spread in the air. Therefore, the foreign materials are included in the air passing through the drum.

The foreign materials contained in the air cause troubles while passing through mechanical components of the dryer. In addition, the foreign materials contained in the air are discharged to the outside of the dryer to injure user's health. Therefore, while the air passing through the drum passes through a filter, the foreign materials should be removed from the air.

SUMMARY OF THE INVENTION

The embodiment proposes a dryer and a foreign material removing apparatus thereof.

A foreign material removing apparatus according to one embodiment includes: a case; a first filter that is housed in the case; and a second filter that is disposed downstream from the first filter based on a flowing direction of air that flows in the case, wherein the first filter and the second filter can perform a relative motion to each other.

A dryer according to another embodiment includes: a cooling passage that performs heat exchange on an external air introduced thereinto and discharges the heat-exchanged air; a circulation passage in which an internal air is heat-exchanged and circulated; a heat exchanger that heat-exchanges air of the cooling passage and the circulation passage; and a foreign material removing apparatus that is provided in the circulation passage and filters foreign materials in the air on the circulation passage, wherein the foreign material removing apparatus includes a first filter and a second filter that is provided to be separately folded with a surface of the first filter at downstream from the first filter.

DETAILED DESCRIPTION OF THE EMBODIMENTS

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Hereinafter, embodiments will be described in detail with reference to the accompanying drawings.

Figure 1:
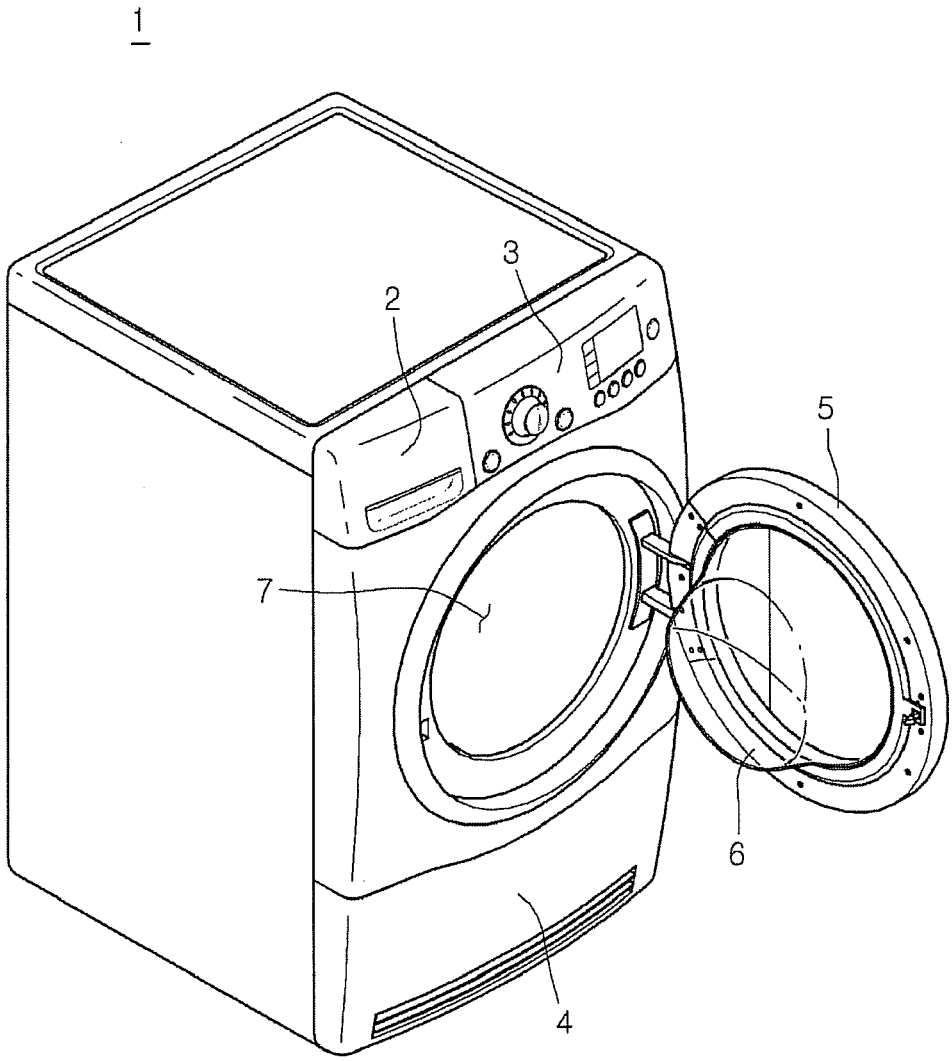
FIG. 1 is a perspective view of a dryer according to a first embodiment.

FIG. 1 is a perspective view of a dryer according to a first embodiment.

Hereinafter, although a condensation-type dryer is described as one example, the spirit of the embodiments is not limited to the condensation-type dryer and is applicable even to an exhaust-type dryer.

Referring to FIG. 1, a dryer 1 according to the embodiment includes a drum 7 that receives moisture containing objects to be dried, such as clothes, etc. and a door 5 that selectively opens and closes an opened front of the drum 7. The door 5 is provided with a transparent window 6. Therefore, a user can view the inside of the drum 7 to confirm the normal operation or not or the occurrence of problems or not.

The dryer 10 further includes a control unit 3, a condensed water collecting part 2, and a cover 4. The control unit 3 plays a role of an interface between the user and the dryer and the condensed water collecting part 2 is a part in which dried water is collected during the operation of the dryer.

The cover 4 is a part that can allow viewing of a structure of mechanical parts inside the dryer 1. The user can separate the cover 4 to remove foreign materials that is contained in a foreign material case (see 80 of FIG. 2) of the dryer 1.

Figure 2:
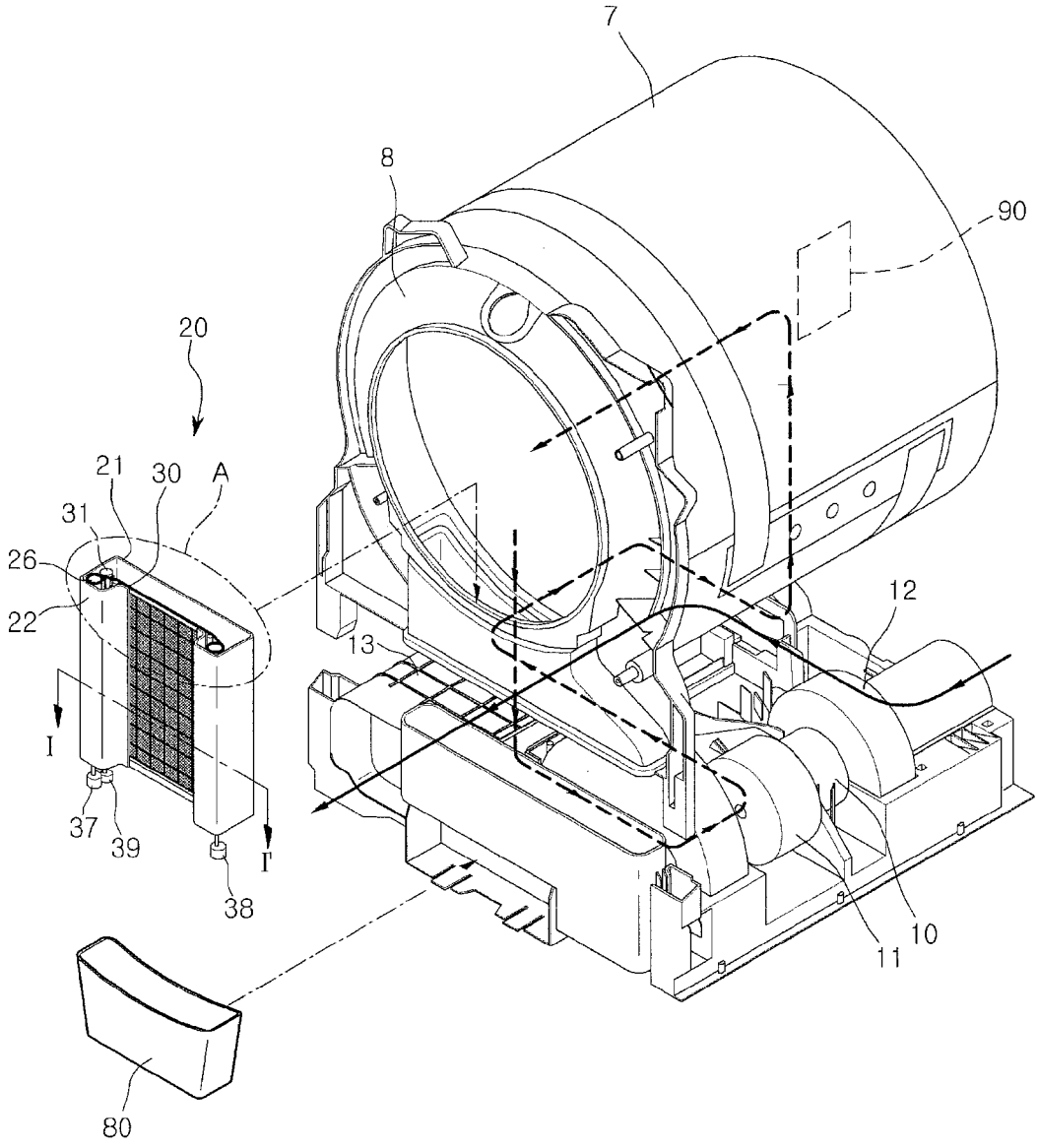
FIG. 2 is a diagram showing an inner structure of the dryer according to the first embodiment.

FIG. 2 is a diagram showing an inner structure of the dryer according to the first embodiment.

An operation of the drum will be described with reference to FIG. 2. The dryer proposed in the embodiments is a condensation-type dryer and the inside of the dryer is formed with two passages.

One of two passages is a circulation passage that takes moisture away from a drying target to contain the moisture and then condenses the moisture in a heat exchanger and the other is a cooling passage that is used to cool fluids that flow to the circulation passage from the heat exchanger.

First, the circulation passage starts from the drum 7 and is shown by a dotted line in FIG. 2. Warm air contains moisture in the drum 7 and is then discharged. Thereafter, foreign materials including at least lint are filtered while passing through a foreign material removing apparatus 20. The foreign materials pass through the foreign material removing apparatus 20 and then pass through a circulation fan 11. The circulation fan 11 is rotated by a motor 10 and provides a negative pressure that forms the circulation channel.

The fluid that passes through the circulation fan 11 is cooled by passing through the heat exchanger 13 and moisture transferred from the drum 7 is condensed due to a low relative humidity during the cooling. The condensed air is pumped by a pump (not shown) and is transferred to the condensed water collecting part 2. The fluid from which moisture is removed by the condensation operation is heated by a heater 90 and is then introduced into the drum 7 and takes the moisture away from the drying target to contain the moisture while being mixed with the drying target in the drum 7.

The cooling passage is shown by a solid line in FIG. 2. Air is introduced into the cooling passage from the outside of the dryer by the cooling fan 12. The cooling fan 12 is rotated by the motor 10. Air introduced from the cooling fan 12 is introduced into the heat exchanger 13 to cool the fluid on the circulation passage and be then discharged to the outside of the dryer as described above.

The cooling fan 12 and the circulation fan 11 are rotated by the motor 10 and can intermittently receive driving power. As the motor 10 for the forward/reverse rotation of the drum 7, a motor, which can be rotated in two-way, can be used.

Air containing foreign materials in the drum 7 on the circulation passage is discharged through the drum cover 8 as shown in FIG. 2. The drum cover 8 is disposed at the front of the drum 7.

The foreign material containing air is filtered by passing through the foreign material removing apparatus 20. At least a portion of the foreign material removing apparatus 20 is disposed on the drum cover 8 to filter air passing through the drum cover 8.

The foreign material removing apparatus 20 is provided with a filter having a fine net structure that can filter foreign materials exemplified as lint and is provided with a cleaning unit that automatically removes the foreign materials that are filtered by the filter.

Figure 3:
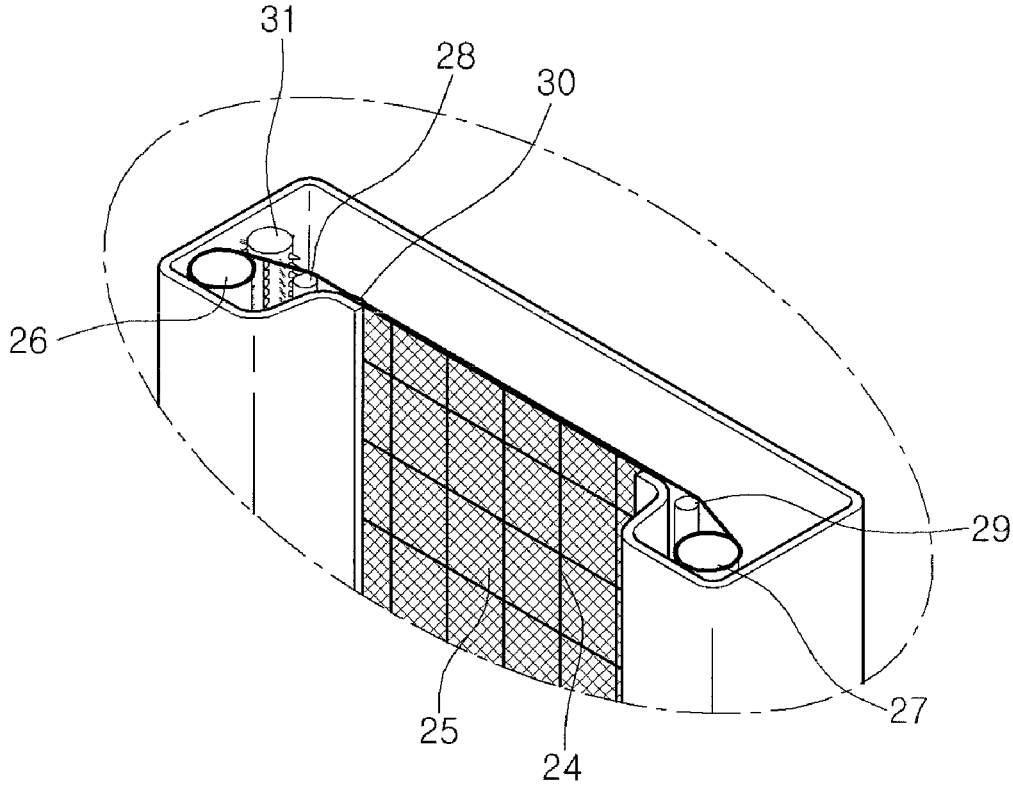
FIG. 3 is an enlarged view of part A of FIG. 2.
Figure 4:
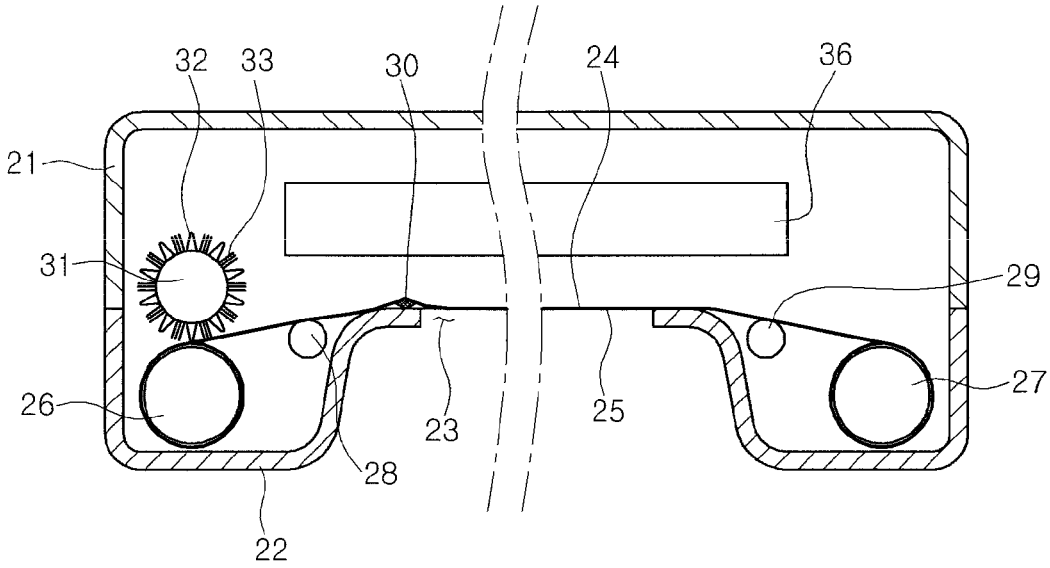
FIG. 4 is a cross-sectional view taken along line I-I' of FIG. 2.

FIG. 3 is an enlarged view of part A of FIG. 2 and FIG. 4 is a cross-sectional view taken along line I-I' of FIG. 2.

FIGS. 2 and 3 show a state where the cover of the ling removing apparatus is removed.

Referring to FIGS. 2 to 4, the foreign material removing apparatus 20 according to the embodiment includes a first case 21 into which foreign material containing air is introduced, a case 22 from which air is discharged, and a filtering unit and a cleaning unit that are positioned in an inner space formed by the first case 21 and the second case 22.

The filtering unit includes a second filter 25 that is provided in an opening part 23 from which the discharges fluid from the second case 22 and a first filter 24 that is formed in the second filter 25. The hole size of the second filter 25 is smaller than the hole size of the first filter 24.

The second filter 25 is fixed to the second case 22 and the first filter 24 can be moved. The foreign materials are filtered while the fluid passes through the second filter 25.

In order for the first filter 24 to be moved, the first filter 24 is made of a soft material and both ends of the first filter 24 are each supported to a first roller 26 and a second roller 27. The rollers 26 and 27 are deflected to the front based on FIG. 2 so that the first filter 24 can contact the second filter 25 side. Idle bars 28 and 29 are provided to guide the movement of the first filter 24. In order to separate a solid material adhered to the second filter 25, a separating part 30 inserted between the second filter 25 and the first filter 24 is lengthily provided up and down at least a portion where the second filter 25 and the first filter 24 are folded each other. The separating part 30 is fixed to one position of the foreign material removing apparatus without moving. The foreign materials adhered to the first filter 24 and the second filter 25 are separated from the second filter 25 by the separating part 30. A separating device 31 is provided at a part adjacent to the first roller 26. The separating device 31 includes a rotating body in a column shape and a brush 33 and a projection 32 that are provided on an outer surface of the rotating body. The projection 32 separates the solid foreign materials by a crushing operation and the brush 33 separates the foreign materials by a shaking operation.

Since the brush 33 and the projection 32 play a role of removing the foreign materials of the filter, they may called as a foreign material removing unit.

Motors 38, 37, and 39 are connected to the rollers 26 and 27 and the separating device 31, the motors 38, 37, and 39 to provide a rotation power to each of them.

The operation of the foreign material removing apparatus will be described below.

First, briefly describing with reference to FIG. 4, the foreign material removing apparatus 20 performs an operation of filtering foreign materials discharged from the drum 7 of the dryer and an operation of removing the filtered foreign materials from the filter.

In detail, the high-humidity high-temperature air, which includes foreign materials, is introduced through the first case 21. The foreign materials of the introduced air are filtered by passing through the first filter 24 and the second filter 25 and the filtered air is discharged through the opening part 23 of the second case 22. The foreign materials may include fluff, dust, etc., which are generated from the object to be dried and other materials, such as dregs of detergent, small dye granule, etc. These foreign materials have viscosity, such that the filtered foreign materials are adhered to the first filter 24 and the second filter 25. Therefore, as the filtered time elapses, when the moisture containing foreign materials is first filtered and then, the amount of moisture is small in the air that flows in the circulation passage after a predetermined time elapses, the foreign materials is slowly hardened. In this state, it is difficult to easily remove the foreign material. At this time, the foreign material may be adhered to the fist filter 24 and the second filter 25.

When the foreign materials are collected above a predetermined level and thus, reaches a level where air is difficult to pass through the filter, the foreign materials adhered to the filters 24 and 25 should be removed. Removing the foreign materials from the filters 24 and can be performed after a drying cycle ends once, but is not limited thereto. Therefore, some foreign materials are adhered to the filters 24 and 25 and when the adhered foreign materials is hardened, the foreign materials can be removed.

When the foreign materials are removed from the filters 24 and 25, a physical state where the foreign materials are adhered to the filters 24 and 25 should be understood. As described above, the foreign materials adhered to the filters 24 and 25 are hardened above a predetermined strength and are mainly adhered to the second filter 25, and slightly adhered to the first filter 25. In this state, when the second filter 25 and the first filter 24 are moved while inserting a thin part therebetween, the second filter 25 and the first filter 24 are separated from each other and the hardened foreign materials are adhered only to the first filter 24. This is due to the strength of the cured foreign materials. In this case, when the hole size of the first filter 24 is excessive large, even though the second filter 25 and the first filter 24 are separated from each other, the first filter 24 breaks or passes through the foreign materials and when the hole size of the first filter 24 is excessive small, even though the second filter 25 and the first filter 24 are separated from each other, it is difficult to separate the foreign materials from the first filter 24 by the separating device 31. Therefore, it is preferable that the hole of the first filter has an appropriate size to solve the above-mentioned two problems.

The operation of the foreign material removing apparatus will be further described with reference to the hardened state of the foreign materials. In order to remove the foreign materials that are hardened to the first filter and the second filter 25, the rollers 26 and 27 are rotated. In other words, the first roller 25 is rotated in a direction that winds the first filter 24 and the second roller 27 is rotated in a rotation that releases the first filter 24. Primarily, the foreign materials, which are adhered to the second filter 25 during the movement of the first filter 24 with respect to the fixed second filter 25, are separated and secondarily, the foreign materials are to the outside of the first filter 24 while passing through the separating part 30. Since the pushed foreign materials are removed by the separating device 31, they are separated from the first filter 24 and drop through the foreign material discharge hole 36 and are stored in the foreign material case 80.

At this time, the brush 33 and the projection 33 are provided in the separating device. The reason is that the projection 32 is to break the hardened foreign materials and the brush 33 shakes off the foreign materials adhered to the first filter 24 in the broken state. This process is performed during a predetermined time, such that the foreign materials are removed and then, the rollers 26 and 27 are rotated in an opposite direction.

If necessary, the foreign materials are strongly adhered to the second filter 25, such that when the rollers and 27 are rotated, the adhering force of the foreign materials to the second filter 25 is too strong, thereby causing a case where the roller is not rotated. In order to solve the above-mentioned problem, the hole size of the first filter is small, such that the adhering strength of the foreign materials adhered to the second filter 25 can be small. Alternatively, a structure that the separating part 30 is not fixed to the foreign material removing apparatus 20, but a structure that the separating part 30 can be moved, for example, a structure that a rack is connected to the separating part and a pinion is fixed to the foreign material removing apparatus to perform the translational motion of the separating part perform is used, such that the separating part 30 is moved left and right, thereby making it possible to first remove the foreign materials adhered to the second filter 25.

The above-mentioned embodiment filters the foreign materials such as lint generated from the dryer, etc., to improve the cleanliness of the object to be objected as well as automatically the foreign materials from the filter used for the foreign material removing apparatus, thereby maximizing the convenience of user. In the state where the foreign materials filtered in the foreign material removing apparatus are removed, the foreign materials can be more clearly removed in the foreign material removing apparatus.

The embodiment is not limited to the embodiment as described above and may have other modified examples For example, the brush and the projection are not provided in the separating device, but only the brush may be provided therein and two separating devices may be provided to correspond to the roller. The idle bars 28 and 29 gives tension to the first filter, such that the foreign materials can be further smoothly removed in the separating device 31. To this end, ones side of the first idle bar 28 may be provided with a spring that pushes the first idle bar 28 toward the separating device 31.

Figure 5:
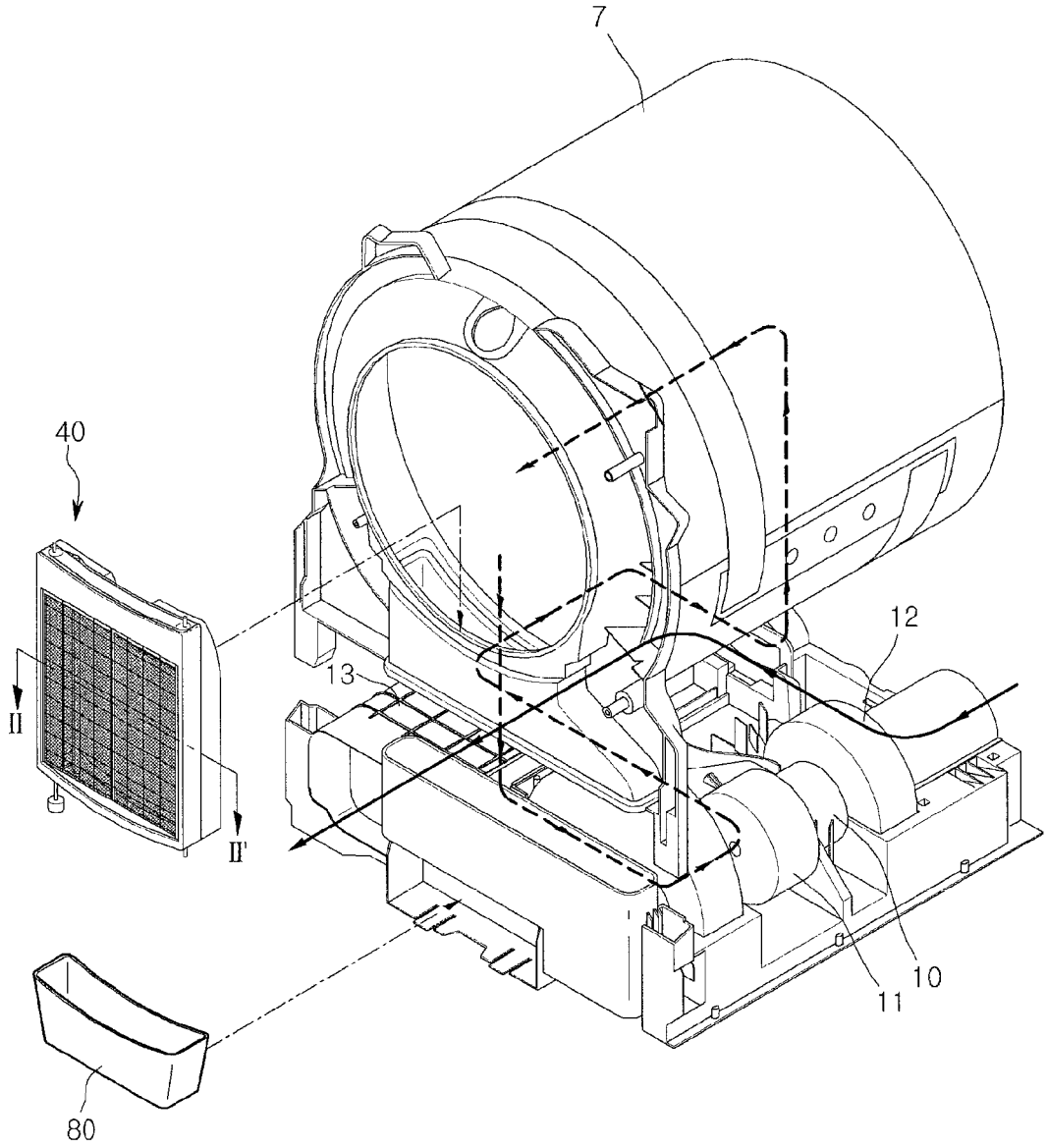
FIG. 5 is an inner perspective view of a dryer according to a second embodiment.
Figure 6:
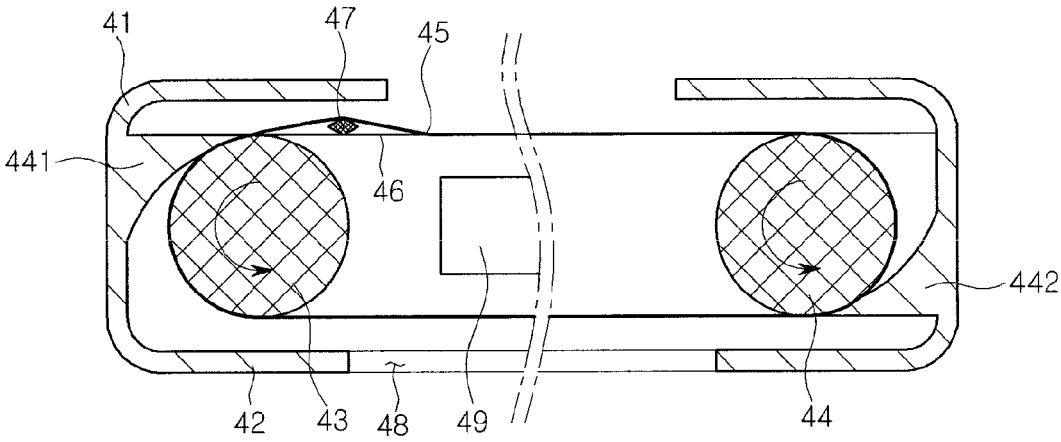
FIG. 6 is a cross-sectional view taken along line II-II' of FIG. 5.

FIG. 5 is an inner perspective view of a dryer according to a second embodiment and FIG. 6 is a cross-sectional view of line II-II of FIG. 5.

The components of the second embodiment are the same as the first embodiment except for a foreign material removing apparatus. Therefore, characteristic components of the second embodiment will be described below and components, which are not described in detail, will recite the description of the first embodiment.

Referring to FIGS. 5 and 6, a foreign material removing apparatus 40 of the second embodiment includes a first case 41 and a second case 42.

A pair of rollers 43 and 44 are disposed in an inner space of the first case 41 and the second case 42. The pair of rollers 43 and 44 has a structure that they contact the first filter 45 and the second filter 46. The first filter 45 and the second filter 46 surrounds the pair of rollers 43 and 44 in the state where they form a loop.

A scratch device as separating devices 441 and 442 is provided at a place where it substantially approaches an outer peripheral surface of the rollers 43 and 44. The separating part 47 is inserted between the first filter 45 and the second filter 46, such that the first filter 45 and the second filter 46 are separated from each other at one point through which the filter passes.

The operation of the foreign material removing apparatus according to the second embodiment will be described.

Air is introduced into an inner space that is defined by the first case 41 and the second case 42, the foreign materials are filtered by passing through the filters 45 and 46, and the filtered foreign materials are discharged through the opening part 48. The foreign materials are filtered by the filter that is mainly disposed at the upper side while they pass through the filters 45 and 46. In other words, the foreign materials are filtered by a part that is disposed at the upper side based on FIG. 6, pass through a part that is disposed at the upper side and are then approximately filtered. To this end, a predetermined shielding structure or a sealing structure may be further provided so that air passes through a part that is disposed at the upper side. Of course, the foreign materials can be filtered by a part that is disposed at the lower side. In this case, since another separating device, which removes the foreign materials, is further provided, it is not preferable in view of cost.

The foreign materials are adhered to the filters 45 and 46 above the predetermined level due to the repeated use and are then hardened, thereby removing the filtered foreign materials. In order to remove the foreign materials, the rollers 43 and 44 are rotated and therefore, the filters 45 and 46 are rotated. In order for the filters 45 and 46 to be smoothly rotated, it is preferable to give a predetermined tension to the filters 45 and 46.

It passes through the separating part 47 during the rotation (movement) operation of the filter. The separating part 47 is disposed between the first filter 45 and the second filter 46, such that when the first filter 45 and the second filter 46 are rotated, the foreign materials adhered to the second filter 46 are separated to the first filter 45 side. In order to smoothly implement the separation operation of the foreign materials, the hole size of the first filter will recite the contents described in the first embodiment.

The foreign materials are separated to the first filter 45 side by the separating part 47 and are scratched by the separating parts 441 and 442 and are removed in the first filter 45 side. The removed foreign materials drop to the foreign material case 80 through the foreign material discharge hole 49 and are stores therein. It can be understood that the separating devices 441 and 442 separate the hardened foreign materials by the operation of scratching the surface of the filter 45.

The above-mentioned operation can be repeatedly performed for a predetermined time until the foreign materials are sufficiently removed.

With the second embodiment, the required amount of the filter is small and the structure of the filter is simple, such that the manufacturing cost is reduced as compared to the first embodiment.

Figure 7:
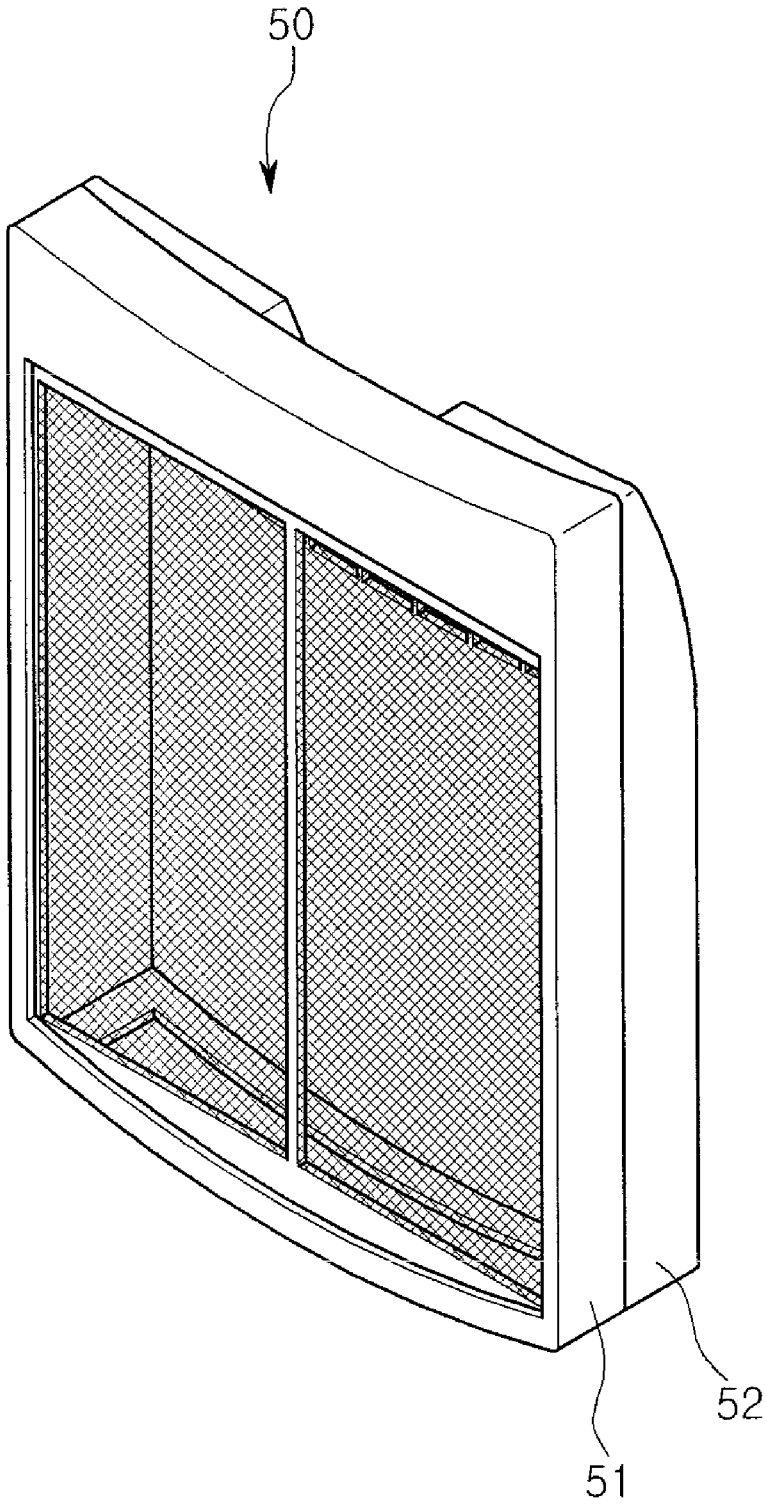
FIG. 7 is an inner perspective view of a dryer according to a third embodiment.
Figure 8:
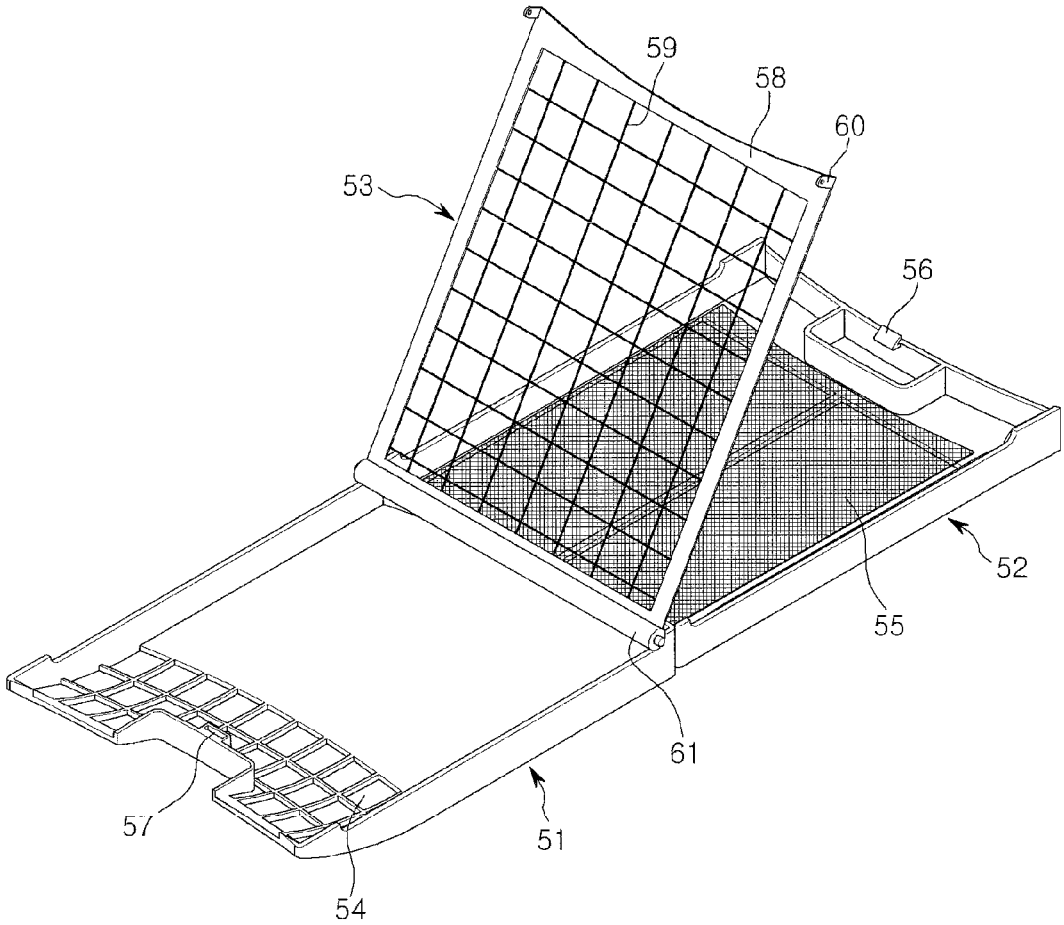
FIG. 8 is a perspective view of a foreign material removing apparatus shown in FIG. 7.

FIG. 7 is an inner perspective view of a dryer according to a third embodiment and FIG. 8 is a perspective view of a foreign material removing apparatus shown in FIG. 7.

The components of the third embodiment are the same as the first embodiment except for the foreign material removing apparatus. Therefore, characteristic components of the third embodiment will be described below and components, which are not described in detail, will recite the description of the first embodiment.

Referring to FIGS. 7 and 8, a foreign material removing apparatus 50 of the third embodiment includes a first case 51 and a second case 52. The inner space, which is defined by the cases 51 and 52, is provided with a rotation body 53. The cases 51 and 53 and the rotation body 53 can be moved independently from each other by a hinge 61.

In detail, the first case 51 is formed with an introduction hole 54 into which fluids are introduced and a fastening groove 57 is formed on the upper side of the introduction hole 54. The second case 52 is formed with the second filter 55 and a fastening projection is provided at a position corresponding to a fastening groove 57. The rotation body 53 is provided with a frame 58 and a first filter 59 that is formed in an inner area part of the frame 58. The end of the frame 58 is provided with a spacer 60, such that the rotation body 53 is pushed to the second filter 55 side, thereby substantially contacting the second filter 55 to the first filter 59.

It is expected that the third embodiment does not require the foreign material case 80 that is used in other embodiments.

The operation of the foreign material removing apparatus according to the third embodiment will be described.

The spacer 60 contacts the first case 51 such that the rotation body 53 is pushed to the second case 52 side in the state where the first case 51 and the second case 52 are closed. The first filter 59 approximately contacts the second filter 55. In this state, the foreign material removing apparatus is mounted in the dryer, thereby operating the dryer.

The foreign materials are collected in the foreign material removing apparatus above a predetermined level and should then be removed. In order to remove the foreign materials, the foreign material removing apparatus 50 is separated from the mounting portion of the dryer side to separate the first case 52 and the first case 51. At this time, the rotation body 53 approximately contacts the second case 52. In other words, the first filter 59 and the second filter 55 contact each other by the operation of the foreign materials that are adhered to the filters 55 and 59.

When the user pulls the rotation body 53 by using the spacer 60, etc., the rotation body 53 is rotated and pushed forward by the hinge 61. The foreign materials, which are adhered to the first filter 59 and the second filter 55, are separated from the second filter 55 by the strength of the foreign materials, but are pulled out in the state where they are adhered to the first filter 59. In other words, the hardened foreign materials are adhered only to the first filter 59. Since the foreign materials are adhered only to the first filter 59, the coupling strength thereof is weak and the foreign materials can be easily separated from the first filter 59. When the user pulls out the foreign materials from the first filter 59, the removal of the foreign materials is completed. The hole size of the first filter 49 for the easy separation operation of the foreign materials is already described.

With the third embodiment, the user can conveniently remove the firmly adhered foreign materials in the foreign material removing apparatus without using the foreign material removing apparatus of the complicated structure.

Figure 9:
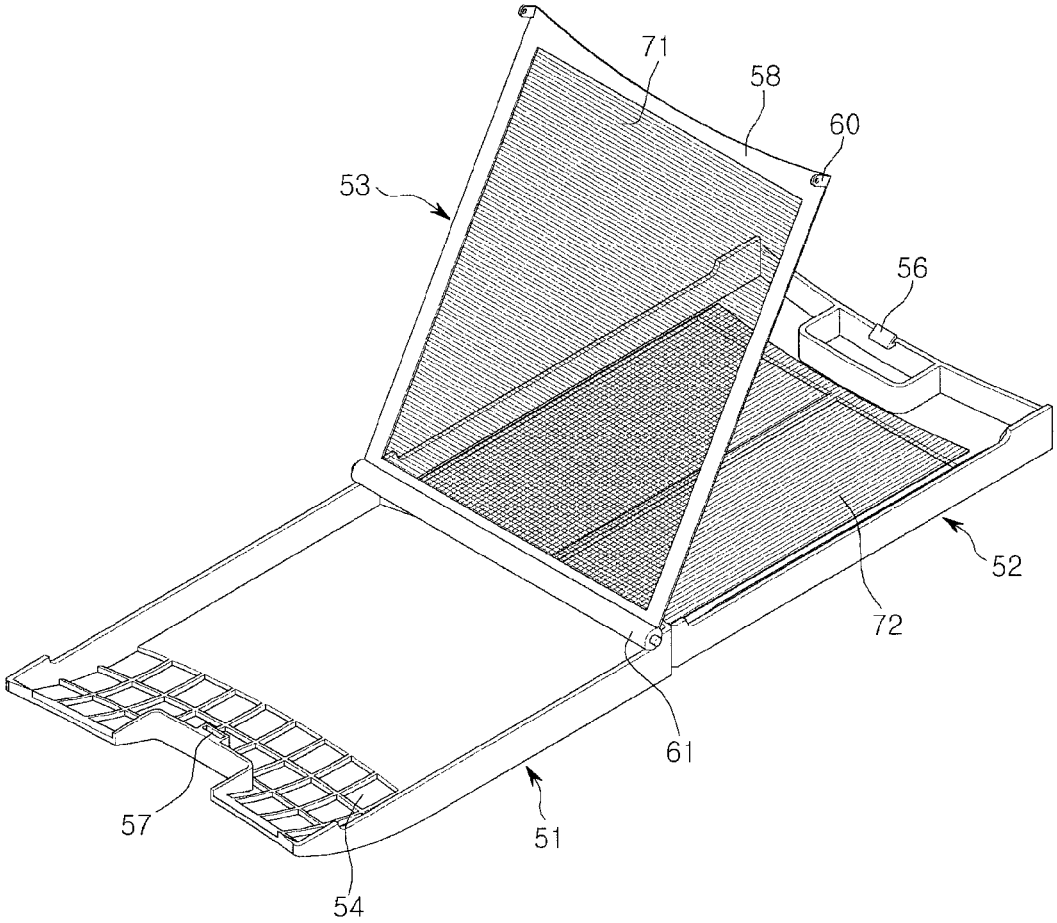
FIG. 9 is a perspective view of a foreign material removing apparatus according to a fourth embodiment.

FIG. 9 is a perspective view of a foreign material removing apparatus according to a fourth embodiment.

The fourth embodiment is different from the first to third embodiments in that a filter, which performs the operation of the first filter and the second filter, is different from the above-mentioned embodiments.

Other components of FIG. 9 are the same as the above-mentioned embodiments, wherein a first filter 71, which is provided at a position of the first filter (see 59 of FIG. 8) of the third embodiment and is formed of a plurality of horizontal nets that extends in a left and right direction and a second filter 72, which is positioned at a position of the second filter (see 55 of FIG. 8) of the third embodiment and is formed of a plurality of vertical nets that extends in a up and down direction are provided. Other components are the same as the third embodiment.

The operation of the foreign material removing apparatus according to the fourth embodiment will be described.

The first filter 71 and the second filter 72 are folded with each other, such that a net structure having a predetermined size of mesh is formed. When the net structure is formed, the foreign materials are filtered while air passes through the net. When the same operation is repeatedly performed for a predetermined time as described above, the filtered foreign materials are adhered and hardened.

The first filter 71 is spaced from the second filter 72. In other words, the rotation body 53 is rotated based on the hinge 61, such that the foreign materials are separated from the second filter 72 in the state where they are adhered to the first filter 71. Thereby, the adhesion force of the foreign materials to the filters 71 and 72 is small and therefore, the user can conveniently remove the foreign materials.

In the fourth embodiment, the extension direction of the vertical direction and the horizontal direction that forms the filter may be not necessarily the shown direction and the mesh is formed only by crossing the vertical direction with the horizontal direction.

Meanwhile, forming a vertical rod of the first filter 71 to be coarser than a horizontal rod of the second filter 72 is preferable to remove the foreign materials. However, the embodiment is not necessarily limited thereto, the coarse degree may be the same or the first filter may be provided to be finer. However, since it is difficult to remove the adhered foreign material in this case, it is difficult to preferably apply, but it is not impossible as the problem of efficiency.

The filter proposed in the fourth embodiment is likewise applied to the first to third embodiments and it is apparent to those skilled in the art that the filter can be used instead of the first filter and the second filter. For example, in the case of the first embodiment, the second filter 25 can be provided with a plurality of vertical rods and the first filter 24 can be provided with a plurality of horizontal rods. In this case, it is preferable that the coarse degree is the degree proposed in the description of each embodiment but is not necessarily limited thereto and therefore, can be considered as the problem of efficiency of removing the foreign materials.

What is claimed is:

1. A foreign material removing apparatus, comprising:
a case;
a first filter housed in the case;
a second filter disposed downstream from the first filter based on a direction of air flow in the case, wherein at least a portion of a front surface of the first filter contacts a rear surface of the second filter; and
a separating part that separates the front surface of the first filter from the rear surface of the second filter, wherein at least one of the first filter or the second filter performs a relative motion with respect to the other.

2. The foreign material removing apparatus according to claim 1, further comprising:
a separating device that separates foreign materials from the first filter.

3. The foreign material removing apparatus according to claim 2, wherein the separating device is movable, and wherein an outer peripheral surface of the separating device is provided with at least one foreign material removing device that removes the foreign materials from the first filter.

4. The foreign material removing apparatus according to claim 2, wherein the first filter is movably provided, and wherein the separating device is fixed in the case and removes the foreign materials from the movable first filter.

5. The foreign material removing apparatus according to claim 2, wherein the case includes a foreign materials discharge hole that discharges the foreign materials separated from the first filter by the separating device.

6. The foreign material removing apparatus according to claim 2, further comprising:
a plurality of rollers that moves the first filter, wherein the first filter contacts the plurality of rollers.

7. The foreign material removing apparatus according to claim 2, further comprising:
a plurality of rollers that supports the first filter and the second filter, wherein each of the first and second filters surrounds the plurality of rollers in a state in which they form a loop.

8. The foreign material removing apparatus according to claim 1, wherein a hole size of the first filter is larger than a hole size of the second filter.

9. A dryer, comprising:
a cooling passage that performs heat exchange on an-external air introduced thereinto and discharges heat-exchanged air;
a circulation passage in which internal air is heat-exchanged and circulated;
a heat exchanger that heat-exchanges air in the cooling passage and the circulation passage; and
a foreign material removing apparatus provided in the circulation passage that filters foreign materials in the air in the circulation passage, wherein the foreign material removing apparatus includes:
a first filter;
a second filter provided downstream from the first filter, wherein at least a portion of a front surface of the first filter contacts a rear surface of the second filter; and
a separating part inserted between the front surface of the first filter and the rear surface of the second filter.

10. The dryer according to claim 9, further comprising:
a separating device that removes foreign materials from the first filter, wherein the first filter is movable with respect to the second filter.

11. The dryer according to claim 10, further comprising:
a foreign materials case that stores the foreign materials separated from the first filter.

12. The dryer according to claim 10, further comprising:
a plurality of rollers that supports the first filter, wherein the first filter is wound on any one of the plurality of rollers and is released from another roller of the plurality of rollers.

13. A foreign material removing apparatus, comprising:
a case;
a first filter disposed in the case;
a second filter disposed downstream from the first filter in a direction of air flow in the case, wherein the first and second filters having different size holes from each other;
a plurality of rollers including first and second rollers that support the first filter disposed at both sides of the first filter, respectively;
a separator disposed between the first filter and the second filter that separates the first filter from the second filter; and
a removing device disposed at a position adjacent to at least one of the first roller or second roller that removes foreign materials from the first filter.

14. The foreign material removing apparatus according to claim 13, wherein the first filter is movable by the first and second rollers, wherein the second filter is fixed to the case, and wherein the separator separates the first filter from the second filter as the first filter passes by the separator.

15. The foreign material removing apparatus according to claim 13, wherein the first and second filters are moved in the same direction by the first and second rollers.

* * * * *